US009532652B2

(12) United States Patent
Choi

(10) Patent No.: US 9,532,652 B2
(45) Date of Patent: Jan. 3, 2017

(54) MOON CHAIR

(71) Applicant: Anyplace Concepts Co., Ltd., Xiamen (CN)

(72) Inventor: Kwan Jun Choi, Xiamen (CN)

(73) Assignee: Anyplace Concepts Co., Ltd., Xiamen (CN)

( * ) Notice: Subject to any disclaimer, the term of this patent is extended or adjusted under 35 U.S.C. 154(b) by 8 days.

(21) Appl. No.: 14/606,774

(22) Filed: Jan. 27, 2015

(65) Prior Publication Data

US 2015/0208808 A1 Jul. 30, 2015

(30) Foreign Application Priority Data

Jan. 27, 2014 (CN) ..... 2014 2 0052869 U

(51) Int. Cl.
*A47C 4/48* (2006.01)
*A47C 4/28* (2006.01)
*A47C 5/10* (2006.01)

(52) U.S. Cl.
CPC ..... *A47C 4/48* (2013.01); *A47C 4/286* (2013.01); *A47C 5/10* (2013.01)

(58) Field of Classification Search
CPC ..... A47C 4/48; A47C 4/286; A47C 5/10
USPC ..... 297/16.1
See application file for complete search history.

(56) References Cited

U.S. PATENT DOCUMENTS 5,356,107 A 10/1994 Sinohuiz
5,893,605 A 4/1999 Chang
6,082,813 A 7/2000 Chen
6,179,374 B1 1/2001 Tang
6,247,749 B1 6/2001 Yu
6,302,479 B1 10/2001 Zheng
6,332,646 B1 * 12/2001 Tseng ..... A47C 4/42 297/16.1 X
6,840,573 B1 * 1/2005 Yao ..... A47C 4/02 297/16.1

(Continued)

FOREIGN PATENT DOCUMENTS

DE 19540528 A1 5/1996
WO WO 2005/112703 A1 12/2005

OTHER PUBLICATIONS

U.S. Appl. No. 14/832,338, filed Aug. 21, 2015.

(Continued)

*Primary Examiner* — Anthony D Barfield
(74) *Attorney, Agent, or Firm* — Morgan, Lewis & Bockius LLP

(57) ABSTRACT

A moon chair includes front supporting legs, rear supporting legs and a rest frame connected onto the front and rear supporting legs. The rest frame is of the shape of a circular ring obliquely erected when the rest frame is unfolded. The front and rear supporting legs are connected with the rest frame through first and second connecting seats, respectively. Each of the first or second connecting seats comprises an integral bent metal sheet. The two ends of the metal sheet are respectively provided with pin holes for arranging connecting pins in a penetrating manner. The metal sheets on the first or second connecting seats are respectively and movably connected with the front or rear supporting legs and the rest frame through the connecting pins. One end of the metal sheet on a first connecting seat is bent to a U-shape to cover the corresponding front supporting leg.

14 Claims, 2 Drawing Sheets

(56) References Cited

U.S. PATENT DOCUMENTS

| | | | | |
|---|---|---|---|---|
| 7,011,372 | B1 * | 3/2006 | Hsieh | A47C 4/02 297/16.1 |
| 7,404,601 | B2 * | 7/2008 | Chen | A47C 4/44 297/16.1 |
| 7,758,111 | B2 * | 7/2010 | Chen | A47C 4/286 297/16.2 X |
| 8,303,032 | B1 | 11/2012 | Platta | |
| 2006/0249991 | A1 * | 11/2006 | Hsieh | A47C 4/48 297/16.1 |
| 2010/0308042 | A1 | 12/2010 | Faris | |
| 2011/0248037 | A1 | 10/2011 | Fung | |
| 2011/0248040 | A1 | 10/2011 | McGregor | |
| 2011/0303659 | A1 | 12/2011 | Perlman | |
| 2013/0264340 | A1 | 10/2013 | Zens | |

OTHER PUBLICATIONS

U.S. Appl. No. 14/735,805, filed Jun. 10, 2015.
U.S. Appl. No. 14/735,854, filed Jun. 10, 2015.
U.S. Appl. No. 15/042,514, filed Feb. 12, 2016.
U.S. Appl. No. 14/665,394, filed Mar. 23, 2015.
U.S. Appl. No. 29/570,710, filed Jul. 11, 2016.
U.S. Appl. No. 29/570,714, filed Jul. 11, 2016.
U.S. Appl. No. 29/570,718, filed Jul. 11, 2016.

* cited by examiner

MOON CHAIR

FIELD OF THE UTILITY MODEL

The present utility model relates to a leisure chair, in particular to a moon chair with a simple connecting seat structure.

BACKGROUND OF THE UTILITY MODEL

A moon chair is a leisure chair which is specially designed according to ergonomics for the sake of health of human. This chair is very comfortable, the area of the seat thereof is very large, the entire body of the human can be enclosed when the human sits on the chair, a feeling of being hugged by the chair is obtained and the chair is very comfortable and warm. In order to facilitate the use, generally the moon chair is designed to be in a foldable structure; since the moon chair generally uses a circular rest frame as a backrest and armrest rods, movement of more than two degrees of freedom is produced by the rest frame and the supporting legs during folding, i.e., connecting seats between the rest frame and the supporting legs can realize rotatable connection of at least two different degrees of freedom, so that the connecting parts of this kind are caused to be comparatively complex. Taking a moon chair structure disclosed by the specification of Chinese utility model patent CN202496762U as an example, the connecting seat thereof is formed by assembling two parts, the structure of the parts is complex and the production cost is comparatively high. In addition, the more component parts of the connecting seat are, the more easily fatigue failure is caused and service life is influenced.

SUMMARY OF THE UTILITY MODEL

The present utility model relates to an improvement to a connecting seat of a moon chair and the purpose of the present utility model is to provide a moon chair with a simpler connecting seat structure.

In order to realize the above-mentioned purpose, the present utility model adopts the following technical solution:

A moon chair comprises front supporting legs, rear supporting legs and a rest frame which is connected onto the front supporting legs and the rear supporting legs, wherein the rest frame is of the shape of a circular ring which is obliquely erected when the rest frame is unfolded, the front supporting legs are connected with the rest frame through first connecting seats, the rear supporting legs are connected with the rest frame through second connecting seats, each of the first connecting seats and the second connecting seats comprises an integral bent metal sheet, the two ends of the metal sheet are respectively provided with pin holes for arranging connecting pins in a penetrating manner, the metal sheets on the first connecting seats are respectively and movably connected with the front supporting legs and the rest frame through the connecting pins, and the metal sheets on the second connecting seats are respectively and movably connected with the rear supporting legs and the rest frame through the connecting pins.

After the above-mentioned solution is adopted, since the major component of the connecting seat is the integral bent metal sheet, the structure is simple and the metal sheet can be molded directly by adopting stamping; and since the manufacturing cost of a stamping mold is lower, compared with other complex connecting seat structures, the production cost can be obviously reduced. After the metal sheet is bent, the rotatable connection of two different degrees of freedom of the connecting seat can be very easily realized through connecting pins at the two ends of the metal sheet, and the production and assembling are comparatively convenient.

As an improvement to the present utility model, one end of the metal sheet on the first connecting seat is bent to a U-shape to cover the corresponding front supporting leg. The purpose of the improvement is to increase the contact area between the metal sheet and the front supporting leg, so as to enable the torque transfer between the first connecting seats and the front supporting legs to be more stable and avoid the situation that the connecting positions of connecting pins easily get loose due to the reason that the torque is transferred only through the connecting pins.

Similarly, one end of the metal sheet on the second connecting seat can also be bent to a U-shape to cover the corresponding rear supporting leg.

As a further improvement to the present utility model, the number of the front supporting legs and the number of the rear supporting legs are respectively two, and the part, between the two front supporting legs, of the rest frame is of a disconnected structure. This improvement can prevent the knee joints of legs from being pressed against by the rest frame and increase the sitting comfort when a user sits on or leans against the moon chair.

As a preference, the metal sheet is an iron sheet or a stainless steel sheet. The iron sheet or the stainless steel sheet has certain strength, is not easily deformed and is easy to stamp.

In the figures, front supporting leg—1, rear supporting leg—2, rest frame—3, first connecting seat—4, second connecting seat—5, metal sheet—6, 7, connecting pin—8, 9, 10, 11.

DESCRIPTION OF THE EMBODIMENTS

The present utility model is further described below in combination with the drawings and the specific embodiments.

Figure 1:
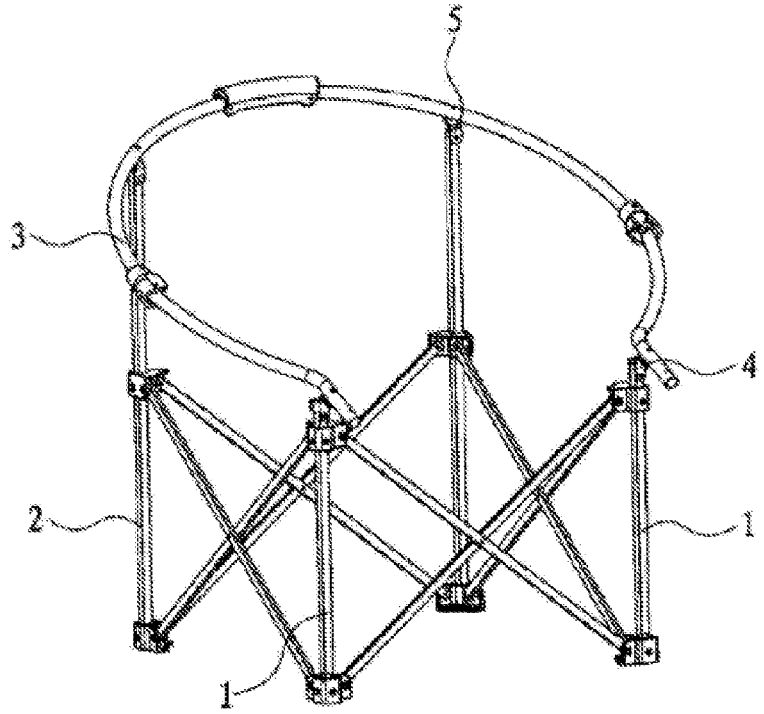
FIG. 1 is a structural schematic view of the moon chair of the present utility model, in which screws and nuts at partial connecting positions are not shown.
Figure 2:
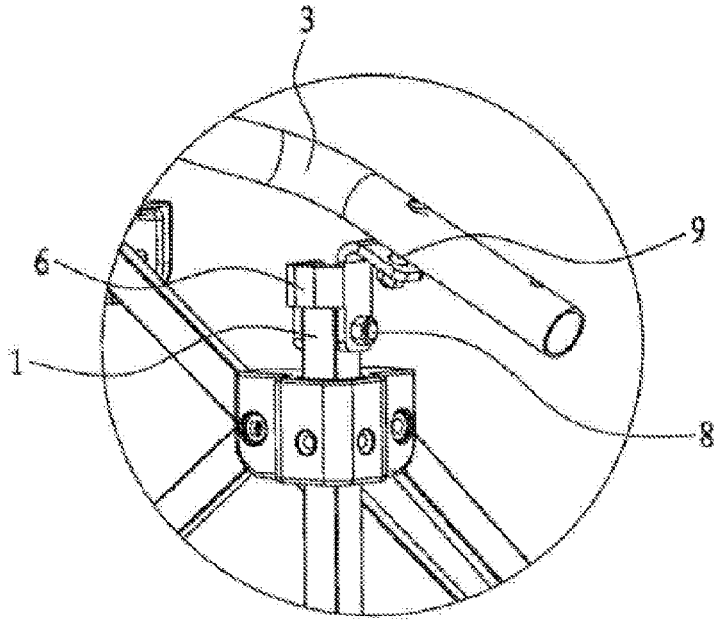
FIG. 2 is a structural schematic view of a first connecting seat of the moon chair of the present utility model.
Figure 3:
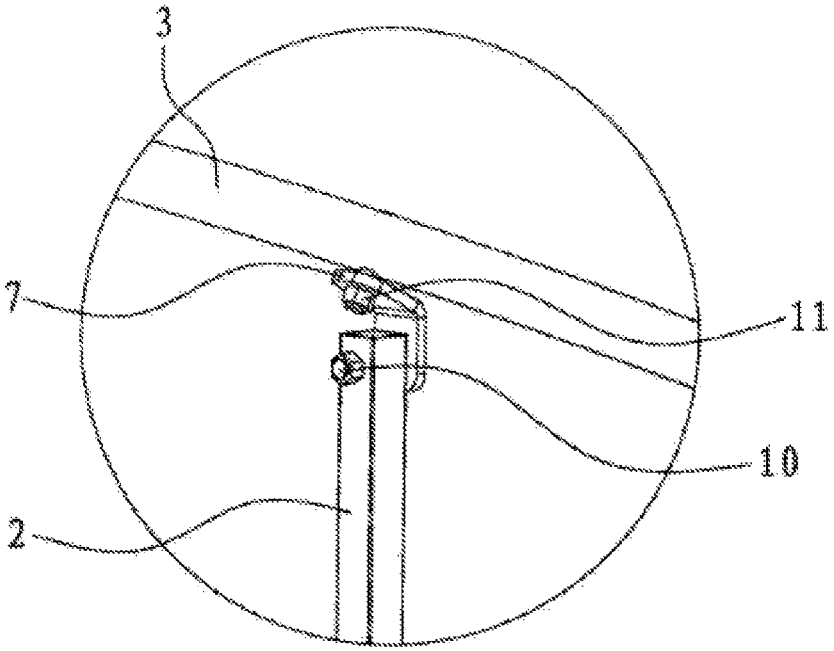
FIG. 3 is a structural schematic view of a second connecting seat of the moon chair of the present utility model.

As shown in FIG. 1, the moon chair of the present utility model comprises front supporting legs 1, rear supporting legs 2 and a rest frame 3 which is connected onto the front supporting legs 1 and the rear supporting legs 2, the rest frame 3 is of the shape of a circular ring which is obliquely erected when the rest frame 3 is unfolded, a chair cloth (which is not shown in the figure) is connected thereon, the number of the front supporting legs 1 and the number of the rear supporting legs 2 are respectively two, and the part, between the two front supporting legs, of the rest frame 3 is of a disconnected structure. The front supporting legs 1 are connected with the rest frame 3 through first connecting seats 4, and the rear supporting legs 2 are connected with the rest frame 3 through second connecting seats 5; as shown in FIG. 2, the first connecting seat 4 comprises an integral bent metal sheet 6 and connecting pins 8, 9; as shown in FIG. 3, the second connecting seat 5 comprises an integral bent metal sheet 7 and connecting pins 10, 11; the two ends of the metal sheet 6, 7 are respectively provided with pin holes for arranging connecting pins in a penetrating manner, the front supporting legs 1 and the rear supporting legs 2 are respectively provided with pin holes corresponding to the pin holes in the metal sheet 6 or 7, and the metal sheets 6, 7 are bent to different shapes according to respective rotating directions. The metal sheets 6, 7 are preferably iron sheets or stainless steel sheets because the iron sheets or the stainless steel sheets have certain strength, are not easily deformed and are easy to stamp; and other different materials can also be selected and used according to needs.

As shown in FIG. 2, in order to increase the contact area between the metal sheets 6 and the front supporting legs 1 and to enable the torque transfer between the first connecting seats 4 and the front supporting legs 1 to be more stable, in this embodiment, the metal sheet 6 on the first connecting seat 4 is bent to a V-shape, one end of the V-shape is then bent to a U-shape, one end which is bent to the U-shape covers the corresponding front supporting leg 1 and is movably connected with the corresponding front supporting leg 1 through a connecting pin 8, and the other end is rotatably connected with the rest frame 3 through a connecting pin 9. In consideration of that the torque between the second connecting seats 5 and the corresponding rear supporting legs 2 during folding is smaller, in order to reduce the cost, in this embodiment, the metal sheet 7 of the second connecting seat 5 is only bent to a V-shape, one end is movably connected with the corresponding rear supporting leg 2 through a connecting pin 10, and the other end is movably connected with the rest frame 3 through a connecting pin 11. However, one skilled in the art shall understand that one end of the metal sheet 7 on the second connecting seat 5 can also be bent to a U-shape to cover the corresponding rear supporting leg 2.

The present utility model is described above in details in combination with the drawings. However, the embodiments of the present utility model are not limited to the above-mentioned embodiments. One skilled in the art can make various modifications to the present utility model according to the prior art, for example, replacing the connecting pin in the present utility model with screws. However, all of those modifications also belong to the protection scope of the present utility model.

What is claimed is:

1. A moon chair, comprising front supporting legs, rear supporting legs and a rest frame connected onto the front supporting legs and the rear supporting legs, wherein the rest frame is of a circular shape obliquely erected when the rest frame is unfolded, the front supporting legs are connected with the rest frame through first connecting seats, and the rear supporting legs are connected with the rest frame through second connecting seats, the moon chair characterized in that:

each of the first connecting seats and the second connecting seats comprises an integral bent metal sheet, wherein two ends of the metal sheet are respectively provided with pin holes for arranging connecting pins in a penetrating manner;

the metal sheets of the first connecting seats are respectively and movably connected with the front supporting legs and the rest frame through the connecting pins;

the metal sheets of the second connecting seats are respectively and movably connected with the rear supporting legs and the rest frame through the connecting pins; and the metal sheet of a respective first connecting seat is bent to a V-shape integrally, and one end of the V-shape metal sheet is integrally bent to a U-shape to increase a contact area and enable more stable torque transfer between the respective first connecting seat and the corresponding front supporting leg.

2. The moon chair according to claim 1, characterized in that one end of the metal sheet of a respective second connecting seat is bent to a U-shape to cover the corresponding rear supporting leg.

3. The moon chair according to claim 1, characterized in that the number of the front supporting legs and the number of the rear supporting legs are respectively two, and the rest frame is disconnected between the two front supporting legs.

4. The moon chair according to claim 1, characterized in that the metal sheet is an iron sheet or a stainless steel sheet.

5. A moon chair, comprising:

front supporting legs;

rear supporting legs;

a rest frame;

first connecting seats connecting the front supporting legs with the rest frame, wherein each of the first connecting seats comprises a first metal sheet integrally bent to a V-shape, wherein one end of the V-shape first metal sheet is moveably connected to a corresponding front supporting leg and integrally bent to a U-shape to increase a contact area and enable more stable torque transfer between the respective first connecting seat and the corresponding front supporting leg, and the other end of the V-shape first metal sheet is moveably connected to the rest frame; and second connecting seats connecting the rear supporting legs with the rest frame, wherein each of the second connecting seats comprises a second metal sheet moveably connected to a corresponding rear supporting leg and moveably connected to the rest frame at the other end of the second metal sheet, wherein the rest frame is obliquely erected when the moon chair is unfolded.

6. The moon chair of claim 5, wherein the first metal sheet is formed with pin holes at both ends for receiving connecting pins.

7. The moon chair of claim 5, wherein the second metal sheet are formed with pin holes at both ends for receiving connecting pins.

8. The moon chair of claim 5, wherein the rest frame is of a circular shape.

9. The moon chair of claim 5, wherein the front supporting legs comprise two front supporting legs, and the rest frame is disconnected between the two front supporting legs.

10. The moon chair of claim 5, wherein the front supporting legs comprise two front supporting legs, and the rest frame is of a circular shape and disconnected between the two front supporting legs.

11. The moon chair of claim 5, wherein the front supporting legs and the rear legs are substantially vertical and parallel to each other when the moon chair is unfolded.

12. A moon chair, comprising:

two front supporting legs;

rear supporting legs;

a rest frame;

first connecting seats movably connecting the front supporting legs with the rest frame, wherein each of the first connecting seats comprises a first metal sheet integrally bent to a V-shape, wherein one end of the V-shape first metal sheet is moveably connected to a corresponding front supporting leg and integrally bent to a U-shape to increase a contact area and enable more stable torque transfer between the first connecting seat and the corresponding front supporting leg, and the other end of the V-shape first metal sheet is moveably connected to the rest frame; and second connecting seats movably connecting the rear supporting legs with the rest frame, wherein the rest frame is obliquely erected and disconnected between the two front supporting legs when the moon chair is unfolded.

13. The moon chair of claim 12, wherein the rest frame is of a circular shape.

14. The moon chair of claim 12, wherein the two front supporting legs and the rear legs are substantially vertical and parallel to each other when the moon chair is unfolded.

* * * * *